US011867014B2

(12) United States Patent
Gabrielsen et al.

(10) Patent No.: US 11,867,014 B2
(45) Date of Patent: Jan. 9, 2024

(54) DRILLING ASSEMBLY FOR REMOVAL OF AN OBSTACLE IN A CONDUIT

(71) Applicant: Altus Intervention (Technologies) AS, Stavanger (NO)

(72) Inventors: Kristine Falk Gabrielsen, Stavanger (NO); Arne Motland, Stavanger (NO); Lasse Haugland, Bryne (NO)

(73) Assignee: Altus Intervention (Technologies) AS, Stavanger (NO)

( * ) Notice: Subject to any disclaimer, the term of this patent is extended or adjusted under 35 U.S.C. 154(b) by 0 days.

(21) Appl. No.: 17/676,663

(22) Filed: Feb. 21, 2022

(65) Prior Publication Data

US 2023/0091081 A1 Mar. 23, 2023

(30) Foreign Application Priority Data

Feb. 22, 2021 (NO) ..... 20210227
Feb. 15, 2022 (NO) ..... 20220208

(51) Int. Cl.

| | |
|---|---|
| ***E21B 29/00*** | (2006.01) |
| ***E21B 4/00*** | (2006.01) |
| ***E21B 31/00*** | (2006.01) |
| ***E21B 10/26*** | (2006.01) |

(52) U.S. Cl.

CPC ..... *E21B 29/002* (2013.01); *E21B 4/00* (2013.01); *E21B 10/26* (2013.01); *E21B 31/002* (2013.01)

(58) Field of Classification Search

CPC . E21B 29/00; B23B 51/0453; B23B 51/0426; B23B 51/044

See application file for complete search history.

(56) References Cited

U.S. PATENT DOCUMENTS

| | | | | |
|---|---|---|---|---|
| 6,599,063 | B1 | 7/2003 | Capstran | |
| 7,967,535 | B2 * | 6/2011 | Eiserer | B23B 51/0453 408/68 |
| 2010/0101802 | A1 | 4/2010 | Hallundbaek et al. | |
| 2014/0305712 | A1 | 10/2014 | Wilson et al. | |
| 2017/0159385 | A1 | 6/2017 | Kruger et al. | |
| 2018/0179845 | A1 | 6/2018 | Pallin et al. | |

FOREIGN PATENT DOCUMENTS

| | | | | |
|---|---|---|---|---|
| EP | 2638238 | A1 | 9/2013 | |
| NO | 341673 | B1 * | 12/2017 | E21B 10/32 |
| NO | 20162055 | A1 | 12/2017 | |
| WO | 20008104179 | A2 | 9/2008 | |
| WO | 2017097832 | A1 | 6/2017 | |

* cited by examiner

*Primary Examiner* — Robert E Fuller
(74) *Attorney, Agent, or Firm* — GableGotwals

(57) ABSTRACT

A drilling assembly for making a passage in an object within a petroleum well. The drilling assembly comprises a drill bit assembly, a cutting assembly, and both assemblies are fastened to a rotatable drive assembly. The drill bit assembly comprises a drill bit. The cutting assembly comprises a hole saw assembly. The cutting assembly is resiliently displaceable to the drill bit assembly. The drilling assembly comprises a displaceable membrane within the tubular body. The membrane divides an interior of the tubular body in a receiving compartment and an inner compartment.

16 Claims, 13 Drawing Sheets

DRILLING ASSEMBLY FOR REMOVAL OF AN OBSTACLE IN A CONDUIT

CROSS-REFERENCES TO RELATED APPLICATIONS

The United States application claims priority to Norwegian Patent Application Nos. 202110227 filed 22 Feb. 2021 and No. 20220208 filed 15 Feb. 2022, each of which is incorporated herein by reference.

BACKGROUND OF THE INVENTION

This invention concerns a drilling assembly for removal of an obstacle in a conduit. The obstacle may be a top cap or a valve and the conduit may be a well tube in a petroleum well, and in particular a production tubing in a petroleum well. More particularly the drilling assembly comprises a drill bit and a hole saw. Even more particularly the (hole saw) core drill is resiliently and axially displaceable to the drill bit. During operation a full weight on the drilling assembly is first on the drill bit and thereafter seamlessly and without a damaging hard approach transferred to the (hole saw) core drill when the drill bit penetrates the obstacle. The obstacle is drilled and cut away and a cut out disc is securely retrieved within the drilling assembly and brought to the surface together with the drilling assembly.

A completed petroleum well comprises valves in the production tubing. Such valves may be ball valves and flapper valves. On rare occasions such valves do not function properly. For example, due to corrosion, a closed valve does not reopen by ordinary means. Valves that are out of order may be removed by drilling or cutting tools. As this is a rare event, equipment for removal of obstacles in the production tubing is by advantage light and easy to mobilize on a need basis. Equipment that is operated by wireline is a preferred choice.

A petroleum well may be temporary abandoned. The petroleum well is temporarily shut in to make it possible to carry out e.g., modifications on surrounding structures. The well is reopened thereafter. Prior to the shut in, one so called deep barrier valve and one so called shallow barrier valve are installed in the well. After testing and approval of the valves, the x-mas tree is removed and replaced with a temporary top cap. The well pressure below the top cap is monitored during the transition phase between shut in and reopening. In case a leakage through the installed barrier valves is detected, and a pressure builds up, the temporary top cap cannot be removed before a new pressure tight valve is installed in the well. Equipment to control the pressure is installed on the well, and then access is made through the top cap.

The obstacle, such as a valve or a temporary top cap, may be drilled away by using a drill bit. Drilling is a relative fast operation. However, drilling creates swarf, such as flutes of swarf. Drill bits with a large diameter produces more and larger swarf compared to drill bits of smaller diameter. Swarf are pieces of metal that may harm the operation of the well. In general, free pieces of metal are unwanted in a petroleum well.

Ball valves and flapper valves comprise curved surfaces. A drill bit without proper lateral support will slide on the curved surface until the first part of a hole is formed. This hole may not be aligned with the center line of the drilling tool, and the drilling operation may not be performed correctly as the hole is not centralized. This may harm or damage the drill bit.

An unprotected drill bit may be harmed or damaged on entering the well and during displacement through the well tube until the drill bit lands on the obstacle. An unprotected drill bit may also be harmed on withdrawal from the well.

Efficient drilling requires proper weight on the drill bit. If the weight is too large, the drill bit may break off. If the weight is too small, the drilling operation becomes very slow.

It is also known to cut away obstacles in a well tubing. Patent application WO2017/097832 discloses a mill head with a centre opening. The milling action is therefore faster and requires less energy as not all material is removed by milling. The centre opening will create a piece of metal that may drop into the well on penetration through the obstacle.

It is also known to remove obstacles in a well tubing using a tool with a centre drill bit and a hole saw. Patent applications WO2008/104179 and US2018179845 disclose tools of this kind. Obstacles are removed faster by a centre drill bit and a hole saw compared to using a mill head with a centre opening. The hole saw produces a metal disc, and the tool is provided with means for capturing and securing the metal disc on penetration through the obstacle. If the capturing means fail, the disc will drop into the well tubing. The disc may drop into the well immediately after penetration through the obstacle or during the withdrawal from the well. A lost disc must be removed and additional runs into the well with appropriate equipment are needed. This is costly and complicates the operation.

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates more particularly to a drilling assembly for making a passage in an object within a petroleum well. The drilling assembly is adapted to be displaced by a wireline tractor and supplied with a rotational force from a rotational motor.

The drilling assembly comprises a drill bit assembly, a cutting assembly, and a rotatable drive assembly:

- the drilling assembly forms a longitudinal center axis;
- the drill bit assembly and cutting assembly are fastened to the rotatable drive assembly;
- the drill bit assembly comprises a drill bit at a free end; and
- the cutting assembly is formed by a tubular body which at a mouth portion is provided with a hole saw assembly.

The cutting assembly is resiliently displaceable relative to the drill bit assembly along the center axis. The drilling assembly comprises a displaceable membrane within the tubular body. The membrane divides an interior of the tubular body in a receiving compartment of variable volume and an inner compartment of variable volume, and the membrane is fastened to one of the rotatable drive assembly and drilling assembly.

The membrane may be oriented perpendicular to the longitudinal center axis. The membrane may be formed as a disc. The membrane may comprise a central hole. The membrane may be fluid tight. The membrane's circumference may abut partly an inner wall of the tubular body such that the membrane does not act as a seal. The membrane may have a diameter that is substantially equal to the inner diameter of the tubular body, but with a small clearance such that the membrane does not act as a seal.

In an initial position the drill bit may in one embodiment be fully surrounded by the cutting assembly. In an alternative embodiment, the drill bit may be projecting beyond the cutting assembly along the center axis when the drill bit is in the initial position.

The drill bit assembly may comprise a catcher at a distal portion. The drill bit assembly may comprise a retainer at a middle portion. The retainer may comprise a first retainer and a second retainer, and the first retainer and the second retainer may be spaced apart along the drill bit assembly.

The drill bit assembly may comprise a displaceable sleeve adapted to slide along a surface of the drill bit assembly. The displaceable sleeve may form a distal end portion and a proximal end portion. The displaceable sleeve may be formed with an internal chamfer at the proximal end portion. In one embodiment the displaceable sleeve may be provided with a spacer, and the spacer may be adapted to abut an internal face of the tubular body. The spacer may be provided with a slide bearing that may abut the internal face.

The spacer and the sleeve support the drill bit assembly such that the drill bit is rotating around the centre axis.

The rotatable drive assembly may comprise from a proximal end towards a distal end:

- an adapter;
- a drive shaft which is connected to the adapter at a proximal end and to the drill bit assembly at a distal end, said drive shaft being formed with a polygonal cross-section at a proximal end portion;
- a slidable house comprising a central channel and provided with an external circular distal end connected to the cutting assembly;
- a spring encircling the drive shaft between the adapter and the house, and the drive shaft is formed with an enlarged diameter at the distal portion, said enlarged diameter forms a stop face.

The slidable house may be provided with an insert with a central guide formed with a polygonal cross section adapted for receiving the drive shaft.

In one embodiment the house may be provided with at least one radially oriented spring-loaded bolt, and the drive shaft may be provided with at least one recess, said recess may be formed with a sloping proximal end portion and a distal shoulder, and said recess may be adapted to receive the spring-loaded bolt.

In a second aspect the invention relates more particularly to a method for drilling a passage in an object within a petroleum well. The method comprises to:

- provide a drilling assembly as described above and connect the drilling assembly to a wireline tractor;
- displace the drilling assembly within the petroleum well by the wireline tractor and position the drilling assembly in contact with the object;
- engage the rotatable drive assembly and add weight on the drill bit assembly such that the spring becomes partly compressed;
- make a through hole in the object by the drill bit;
- add further weight on the cutting assembly such that the spring becomes further compressed and cut out a disc from the object; and
- displace the cutting assembly forwardly and relative to the membrane by the biasing force of the compressed spring, thereby fluid in the inner compartment is evacuated proximally along the drive shaft and a distance between the membrane and the disc is kept constant by a sub-pressure in the receiving compartment, and thereby the disc follows the membrane in the proximal direction into the receiving compartment.

Fluid in the inner compartment is evacuated proximally along the drive shaft through the central guide of the insert and a central channel of the slidable house.

The method may comprise to provide the drilling assembly with a displaceable sleeve prior to guiding the drilling assembly into the petroleum well, and the sleeve may be positioned on the drill bit assembly to cover the catcher and keep the catcher in a flush state with a surface of the drill bit assembly. The method may comprise to guide the catcher into the through hole in the flush state by abutting the sleeve's distal end portion with the object and displace the sleeve proximally along the drill bit assembly when the drill bit assembly drills through the object. The method may comprise to guide the sleeve over the retainer to squeeze the retainer into a flush state with the surface of the drill bit assembly. The method may comprise to guide the retainer into the through hole in the flush state by abutting the sleeve's distal end portion with the object and displace the sleeve proximally along the drill bit assembly when the drill bit assembly is displaced distally relative to the object.

The method may comprise to keep the retainer positioned within the through hole when the disc is retrieved from the well. The method may comprise to cut two discs from a ball valve and keep the catcher positioned within the second through hole of the distal disc when the discs are retrieved from the well.

In the following is described examples of preferred embodiments illustrated in the accompanying drawings, wherein.

Figure 1:
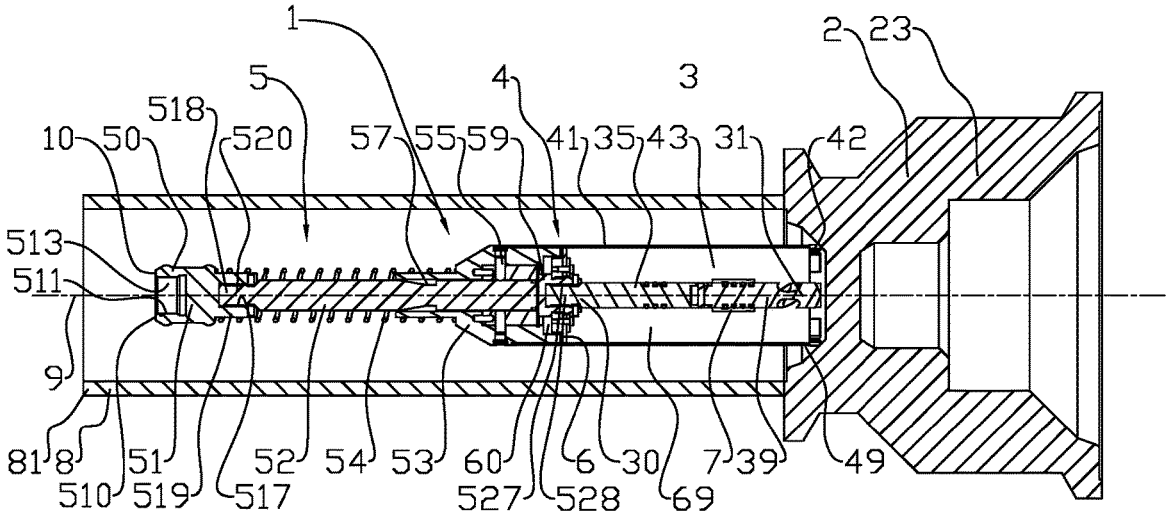
FIGS. 1-6 show in sequence how a drilling assembly according to the invention is positioned within a riser and makes a through hole in a top cap and secures a disc.

In the drawings, the reference numeral 1 indicates a drilling assembly according to the invention. Some reference numerals appear in a limited number of the drawings and are omitted in other drawings for clarity.

The drilling assembly 1 is adapted to make a passage 21 in an object 2 within a petroleum well 8. The object may be a top cap 23 and the drilling assembly 1 is positioned within a riser 81 as shown in FIGS. 1 to 6. The object may be a ball valve 25 and the drilling assembly 1 is positioned within a production tubing as shown in FIGS. 7 to 27. The object may be a flapper valve (not shown).

The drilling assembly 1 comprises a central drill bit assembly 3, a cutting assembly 4, and a rotatable drive assembly 5. The drilling assembly 1 forms a longitudinal centre axis 9. The drilling assembly 1 is connected to a rotational motor (not shown) at a proximal end 10. The drill bit assembly 3 and the cutting assembly 4 is fastened to the rotatable drive assembly 5. The drill bit assembly 3 comprises at a free end 39 a drill bit 31. The cutting assembly 4 is formed by a tubular body 41. The tubular body 41 is at a mouth portion 49 provided with a hole saw assembly 42.

The drilling assembly 1 is shown in an initial position in FIGS. 1, 7, 16, and 17. The drill bit 31 is shown fully surrounded by the cutting assembly 4. In an alternative embodiment, the drill bit 31 may be projecting beyond the cutting assembly 4 along the center axis 9 when the drilling assembly 1 is in the initial position (not shown).

The drilling assembly 1 comprises a displaceable membrane 6 within the tubular body 41. The membrane 6 divides an interior 43 of the tubular body 41 in an inner compartment 60 and a receiving compartment 69. The inner compartment 60 varies in volume according to the position of the membrane 6. Likewise, the receiving compartment 69 varies in volume according to the position of the membrane 6.

The rotatable drive assembly 5 comprises from a proximal end 50 towards a distal end 59 an adapter 51, a drive shaft 52, and a slidable house 53. A spring 54 is encircling the drive shaft 52 between the adapter 51 and the slidable house 53.

The adapter 51 is at a proximal end 510 shown provided with interior threads 511 in a recess 513. The adapter 51 is connected to a rotatable drive system (not shown) of a wireline tractor or the like. The adapter 51 is at a distal end 519 provided with internal threads 517 in a recess 518. The drive shaft 52 is at a proximal end 520 threadly connected to the adapter 51. The drive shaft 52 comprises at a distal end 529 internal threads 527 in a recess 528. The drill bit assembly 3 is at a proximal end 30 connected to the drive shaft 52. In the drawings the drill bit assembly 3 is shown threadly connected to the drive shaft 52.

The drill bit assembly 3 comprises an extended holder 35. The extended holder 35 is at a proximal end 350 shown threadly connected to the drive shaft 52. The extended holder 35 is at a distal end 359 connected to the drill bit 31 (see FIG. 2).

The slidable house 53 comprises at a proximal end 530 a neck portion 531 and at a distal end 539 a head portion 532. The head portion 532 is provided with a distal entrance 533 at the distal end 539. The entrance 533 is shown forming an internal shoulder 534. The drive shaft 52 is at the distal end 529 formed with an enlarged diameter, and a shoulder 525 faces the proximal end 10 (see FIG. 2). The shoulder 525 abuts a stop face 566 when no weight is put on the drive assembly 5 as shown in e.g. FIG. 1.

In one embodiment the slidable house 53 is provided with at least one spring loaded bolt 55 in a radial bore 550. The drive shaft 52 is on a surface 58 provided with at least one recess 57 formed with a sloping proximal end portion 570 and an opposite shoulder 579. The recess 57 is adapted to receive the spring-loaded bolt 55 (see FIGS. 3, 5 and 6).

The drive shaft 52 is shown formed with a polygonal cross section. The slidable house 53 is formed with a central channel 536 from the proximal end 530 to the entrance 533. The central channel 536 is formed with a circular cross section. An insert 56 is positioned within the entrance 533. The insert 56 is formed with a central guide 561 formed with a polygonal cross section adapted for receiving the drive shaft 52. The insert 56 is rotationally, stiffly connected to the slidable house 53 by pins 563. A rotational force on the drive shaft 52 is transferred to the slidable house 53 through the insert 56 and the pins 563 (see FIGS. 4 and 7). The insert 56 is axially locked by a retainer 565 shown as a circlip. In embodiments where the drilling assembly 1 is provided with spring loaded bolts 55, the insert 56 may be provided with corresponding bores as shown in FIGS. 1-6. The insert 56 forms the stop face 566.

In the description and figures, the drive shaft 52 is described as a drive shaft 52 with a polygonal cross-section. In other embodiments (not shown) the drive shaft 52 may be a spline or a shaft with a key. The insert 56 is in such embodiments formed with a central guide 561 adapted to the external profile of the drive shaft 52 such that a rotational force is transferred from the drive shaft 52 to the slidable house 53.

The tubular body 41 is at a proximal end portion 410 fastened to an exterior surface of the head portion 532 of the slidable house 53. The tubular body 41 may in one embodiment be welded to the slidable house 53. The head portion 532 of the slidable house 53 may in one embodiment (not shown) be formed with a threaded circular external surface. The tubular body 41 may comprise internal threads and threadly connected to the head portion 532.

The membrane 6 is shown fastened to the distal end 529 of the drive shaft 52 by a membrane holder 61. The membrane 6 is formed as a disc with a central hole 63. The membrane 6 is positioned between the membrane holder 61 and a washer 65. The membrane holder 61, membrane 6 and washer 65 are joined by a number of bolts 67 (see FIG. 6).

The drill bit 31 is shown provided with a catcher 33. The catcher 33 is positioned in at least one catcher recess 331 (see FIGS. 3, 4 and 7). The catcher 33 is resilient and protrudes from a surface 318 of the drill bit 31 when the catcher 33 is not tensioned.

The extended holder 35 is shown with a retainer 34. The retainer 34 is positioned in at least one retainer recess 340 (see FIGS. 4 and 7). The retainer 34 is resilient and protrudes from a surface 358 (see FIG. 7) of the extended holder 35 when the retainer 34 is not tensioned.

Figure 2:
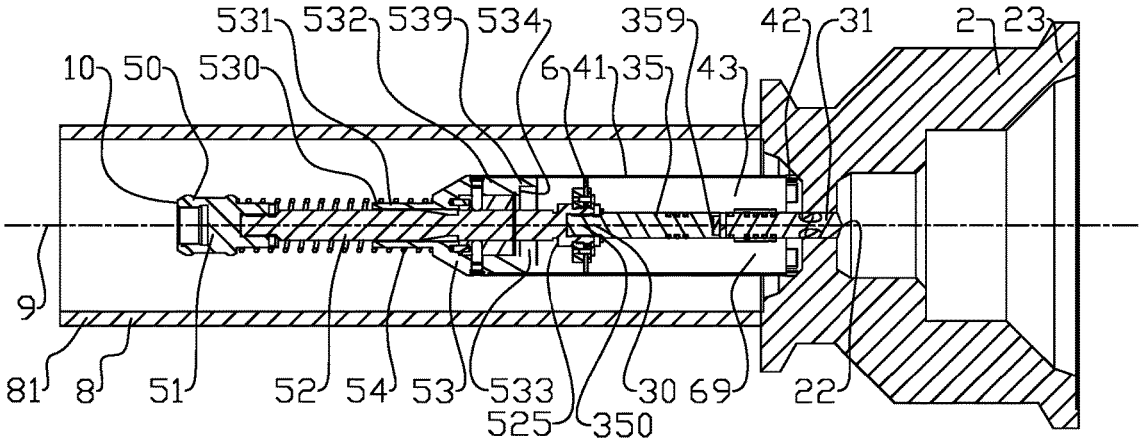

A slidable sleeve 7 is initially positioned on the drill bit 31 as shown in FIGS. 1 and 2, and is during operation displaced to a position on the extended holder 35 as shown in e.g. FIGS. 3 to 6. The sleeve 7 forms a proximal end portion 70 and a distal end portion 79 (see FIG. 5). The proximal end portion 70 is formed with an internal chamfer.

Operation of the drilling assembly 1 is first described for drilling an opening in a top cap 23. The sequence is shown in FIGS. 1 to 6. A riser 81 connects the top cap 23 to the surface. The riser 81 is filled with fluid at a pressure that equalize the pressure within the well as known in the art. The drilling assembly 1 is lowered within the riser 81 by a e.g. wireline tractor (not shown) until the drilling assembly 1 lands on the top cap 23 as shown in FIG. 1. The landing is registered by a decrease in hanging weight. The drilling assembly 1 is withdrawn slightly and the drilling assembly 1 starts rotating. The drilling assembly 1 is displaced towards the top cap 23 until contact and weight on bit is increased. As the connection between the drill bit assembly 3 and the cutting assembly 4 is resilient due to the spring 54, weight on bit is transferred to the drill bit 31 which is axially displaced relative to the cutting assembly 4. The drill bit 31 starts to penetrate the surface of the top cap 23. The cutting assembly 4 is rotationally coupled to the drill bit 31 and rotates on the surface of the top cap 23 without penetrating substantially into the top cap 23 as weight on bit is on the drill bit 31 and only the spring 54 acts on the cutting assembly 4.

Figure 3:
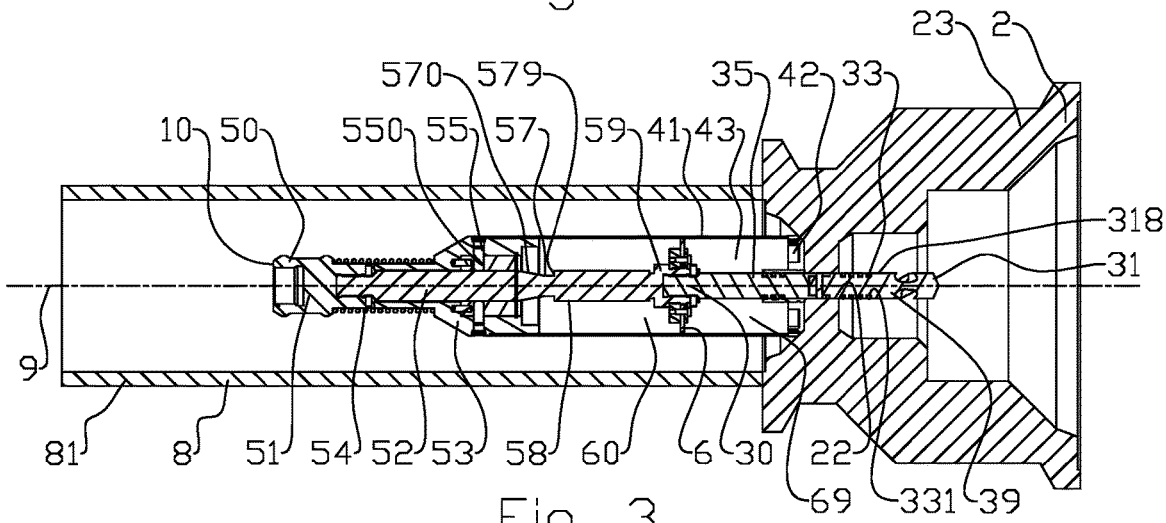

The drill bit 31 makes a through hole 22 in the top cap 23 as shown in FIG. 2. When the drill bit 31 breaks through the top cap 23, there is no axial resistance and the drill bit 31 is displaced to its maximum distal position relative to the cutting assembly 4 as shown in FIG. 3. The spring 54 is compressed and the weight on bit is transferred to the cutting assembly 4. During the displacement of the drill bit 31, the distal end portion 79 of the sleeve 7 abuts the surface of the top cap 23. The sleeve 7 has a larger diameter than the drill bit 31. Thereby the sleeve 7 is axially displaced along the extended holder 35 towards the proximal end 359. The catcher 33 which from the start is retracted within the sleeve 7, enters the through hole 22 in the retracted mode as the inner diameter of the sleeve 7 equals the diameter of the through hole 22. FIG. 3 shows the catcher 33 after the catcher 33 has been fully displaced through the top cap 23. The catcher 33 enters the expanded mode after passage of the through hole 22. The proximal end portion 70 of the sleeve 7 forces the retainer 34 to enter a retracted mode when the chamfered proximal end portion 70 slides over the retainer 34.

Figure 4:
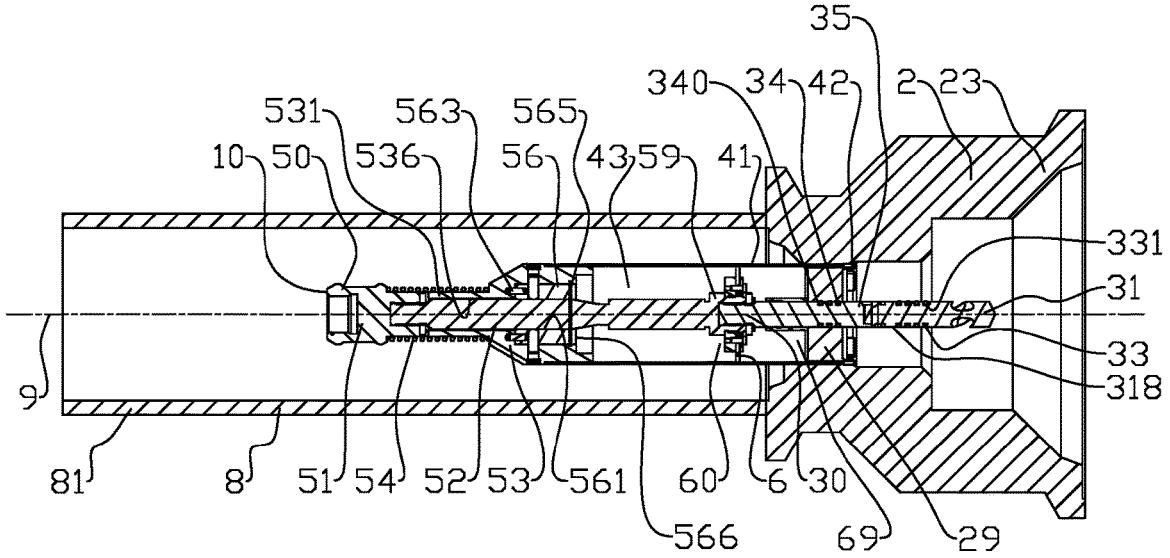
Figure 6:
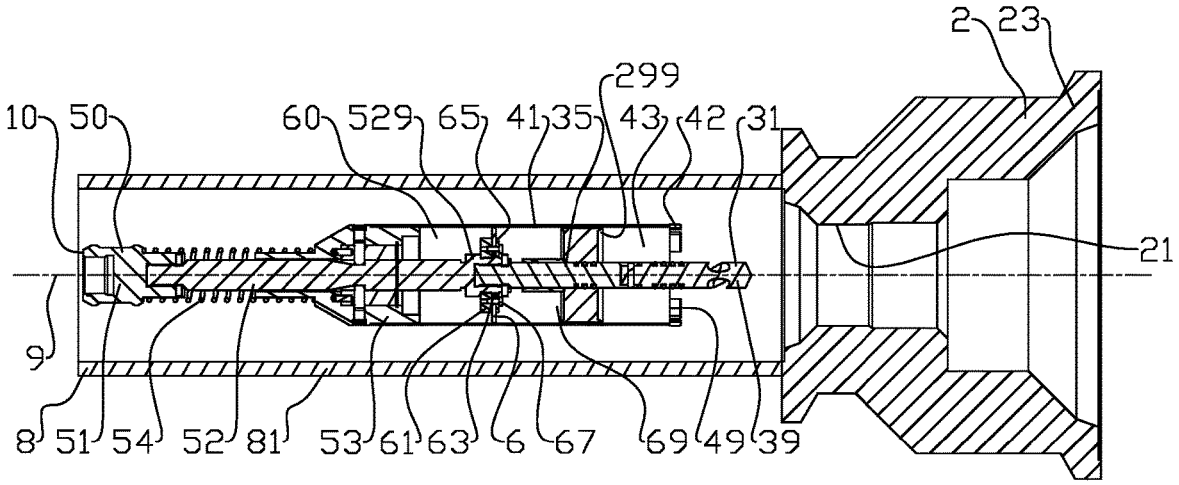

The cutting assembly 4 cuts out a disc 29 and creates a passage 21 in the top cap 23 as best seen in FIG. 6. FIG. 4 shows when the cutting assembly 4 has penetrated the top cap 23 and the disc 29 is within the receiving compartment 69. Due to that the weight on bit is on the cutting assembly 4, the drill bit assembly 3 is axially displaced at the same speed as the cutting assembly 4. This is seen by comparing FIG. 3 and FIG. 4. The extended holder 35 is thereby axially displaced relative to the top cap 23. The sleeve 7 is further displaced along the extended holder 35 towards the proximal end 359. The retainer 34 which is retracted within the sleeve 7, enters the through hole 22 in the retracted mode as the inner diameter of the sleeve 7 equals the diameter of the through hole 22. The thickness of the top cap 23 is known and the axial position of the retainer 34 on the extended holder 35 is adapted to this. When the cutting assembly 4 breaks through the top cap 23, the retainer 34 is positioned within the disc 29 as shown in FIG. 4.

Figure 5:
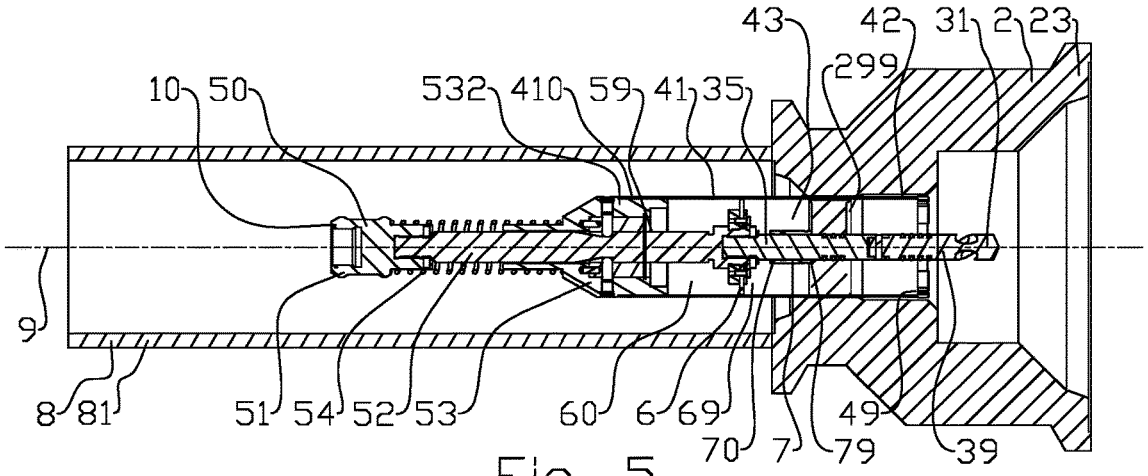

When the cutting assembly 4 breaks through the top cap 23 and forms the passage 21, there is no axial resistance to the drilling assembly 1. The drill bit assembly 3 is via the drive shaft 52 directly connected to the adapter 51. The adapter 51 is connected to the wireline tractor (not shown). Therefore, the drill bit assembly 3 will not be axially displaced. The cutting assembly 4 will be displaced axially in the distal direction due to the compressed spring 54 which is released when there is no axial resistance to the cutting assembly 4. Thereby the cutting assembly 4 is displaced axially relative to the drill bit assembly 3 and the disc 29 as shown in FIG. 5. The length of the relative axially displacement of the cutting assembly 4 is determined by the position of the recess 57. The spring-loaded bolt 55 slides along the surface 58 of the drive shaft 52 until the bolt 55 enters the recess 57 and abuts the shoulder 579. Thereby the cutting assembly 4 is locked relative to the drilling assembly 3 such that the hole saw assembly 42 remains in a proximal position relative to the free end 39 of the drill bit 31 as seen in FIGS. 5 and 6. This arrangement secures that the disc 29 is not pushed in the distal direction past the catcher 33 by the cutting assembly 4 when the cutting assembly 4 is forced towards the drill bit 31 by the spring 54. The catcher 33 is positioned within the mouth portion 49.

The membrane 6 has a diameter that is close to the inner diameter of the tubular body 41, but with a small clearance to an inner wall 411 (see FIG. 7) such that the membrane 6 does not act as a seal. The membrane holder 61 is shown fixed to the drive shaft 52. By comparison of FIGS. 1 to 3, the distal displacement of the membrane 6 increases the volume of inner compartment 60 and decreases the volume of the receiving compartment 69. When the cutting assembly 4 breaks through the top cap 23, the membrane 6 is not displaced. The inner compartment 60 decreases in volume and liquid in the inner compartment 60 is evacuated proximally along the drive shaft 52 through the central guide 561 of the insert 56 and the central channel 536. The receiving compartment 69 expands, which creates a sub-pressure in the receiving compartment 69. The disc 29 has a diameter that corresponds to the internal diameter of the tubular body 41 as a created thin circumferential burr 299 is folded inwards when the whole disc 29 enters the receiving compartment 69. The pressure on the proximal side of the disc 29 is less than on the distal side, and this pressure difference ensures that the disc 29 stays within the tubular body 41 when the cutting assembly 4 is displaced distally relative to the drill bit 31.

The thickness of the top cap 23 is known. The axial distance between the catcher 33 and the retainer 34 is adjusted to the thickness of the top cap 23. Thereby the retainer 34 is positioned within the disc 29 when the cutting assembly 4 breaks through the top cap 23 as seen in FIG. 4. The retainer 34 is adapted to be rotated within the disc 29 without losing the retaining capacity such that when the disc 29 is fully formed, the retainer 34 holds the disc 29, and the disc 29 rotates together with the cutting assembly 4.

Break through of the top cap 23 is noticed by a controlling system (not shown) as a drop of torque and a drop of weight on bit on the drilling assembly 1. The wireline tractor and the drilling assembly 1 is then withdrawn from the top cap 23 as seen in FIG. 6. The disc 29 is shown secured within the tubular body 41 by the retainer 34. The catcher 33 is positioned at the distal side of the disc 29 but within the tubular body 41. This safeguards the disc 29 from falling out of the tubular body 41 during the withdrawal of the drilling assembly 1 in the riser 81. In addition, if the disc 29 is displaced distally relative to the membrane 6, the pressure in the receiving compartment 69 on the proximal side of the disc 29 will drop, and the higher pressure on the distal side of the disc 29 will counteract the distal displacement. Together, these measures will secure that the disc 29 does not fall out of the drilling assembly 1 during withdrawal.

Figure 7:
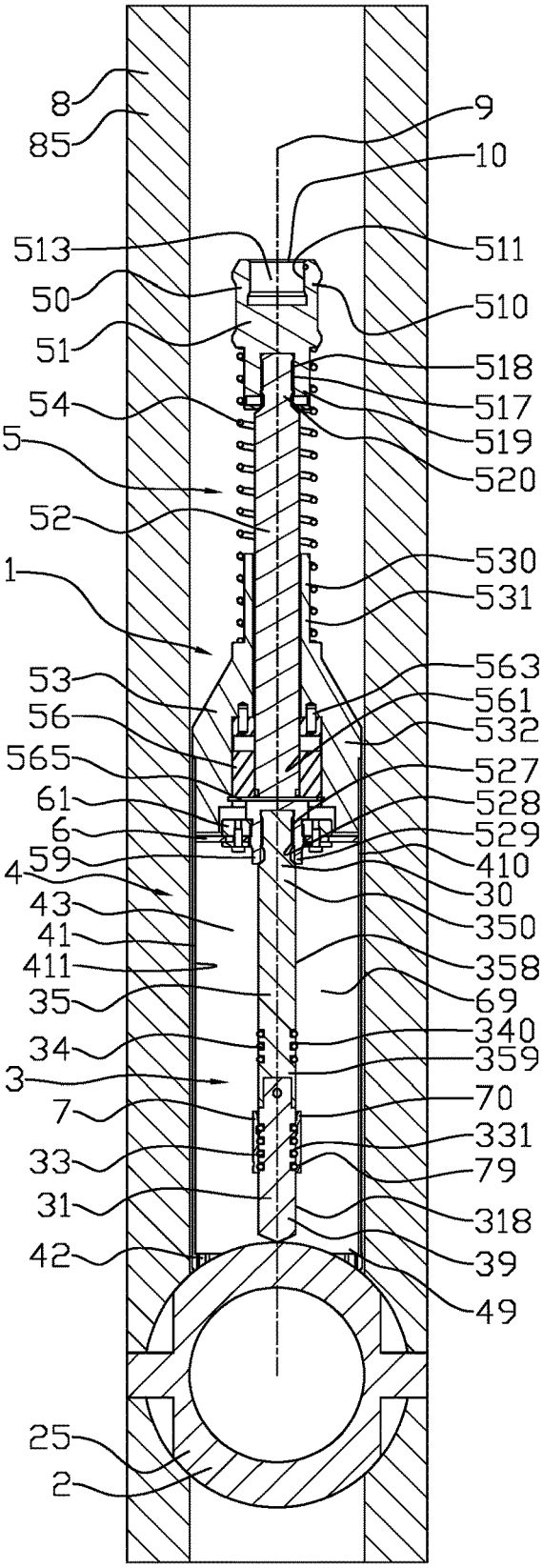
FIGS. 7-15 show in sequence how the drilling assembly makes a through hole in a ball valve within a production tubing and secures two discs.
Figure 17:
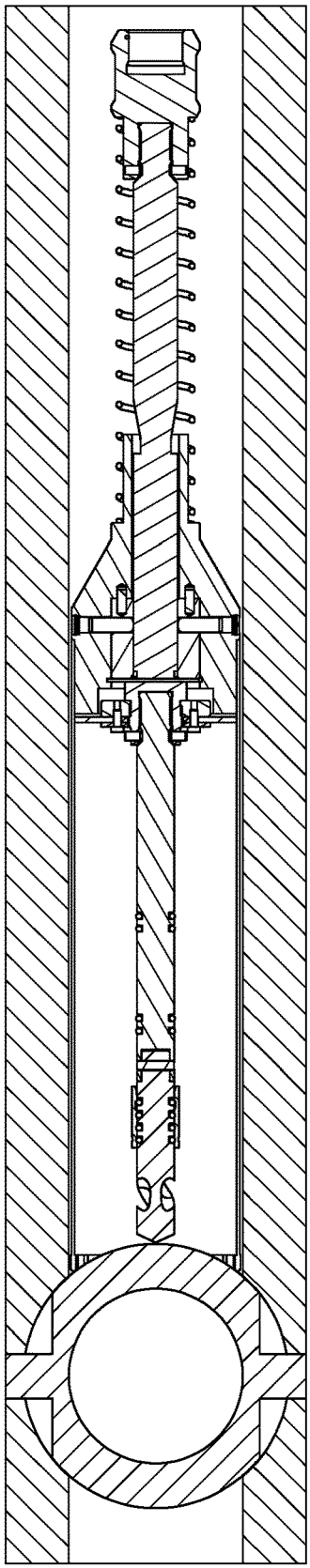
FIG. 17-26 show in sequence how the drilling assembly in an alternative embodiment makes a through hole in a ball valve within a production tubing and secures two discs.

Operation of the drilling assembly 1 is further described for drilling an opening in a ball valve 25. The sequence is shown in FIGS. 7 to 15 and 17 to 26. The ball valve 25 is located within a valve housing 85 which forms part of a production tube. The drilling assembly 1 is lowered within the production tube and further within the valve housing 85 by a e.g. wireline tractor (not shown) until the drilling assembly 1 lands on the ball valve 25 as shown in FIGS. 7 and 17. The landing is registered by a decrease in hanging weight or by an increased resistance to the propulsion of the wireline tractor. The drilling assembly 1 is withdrawn slightly and the drilling assembly 1 starts rotating. The drilling assembly 1 is displaced towards the ball valve 25 until contact and weight on bit is increased. As the connection between the drill bit assembly 3 and the cutting assembly 4 is resilient due to the spring 54, weight on bit is transferred to the drill bit 31 which is axially displaced relative to the cutting assembly 4. The drill bit 31 starts to penetrate the surface of the ball valve 25. The cutting assembly 4 is rotationally coupled to the drill bit 31 and rotates on the surface of the ball valve 25 without penetrating substantially into the ball valve 25 as weight on bit is on the drill bit 31.

Figure 8:
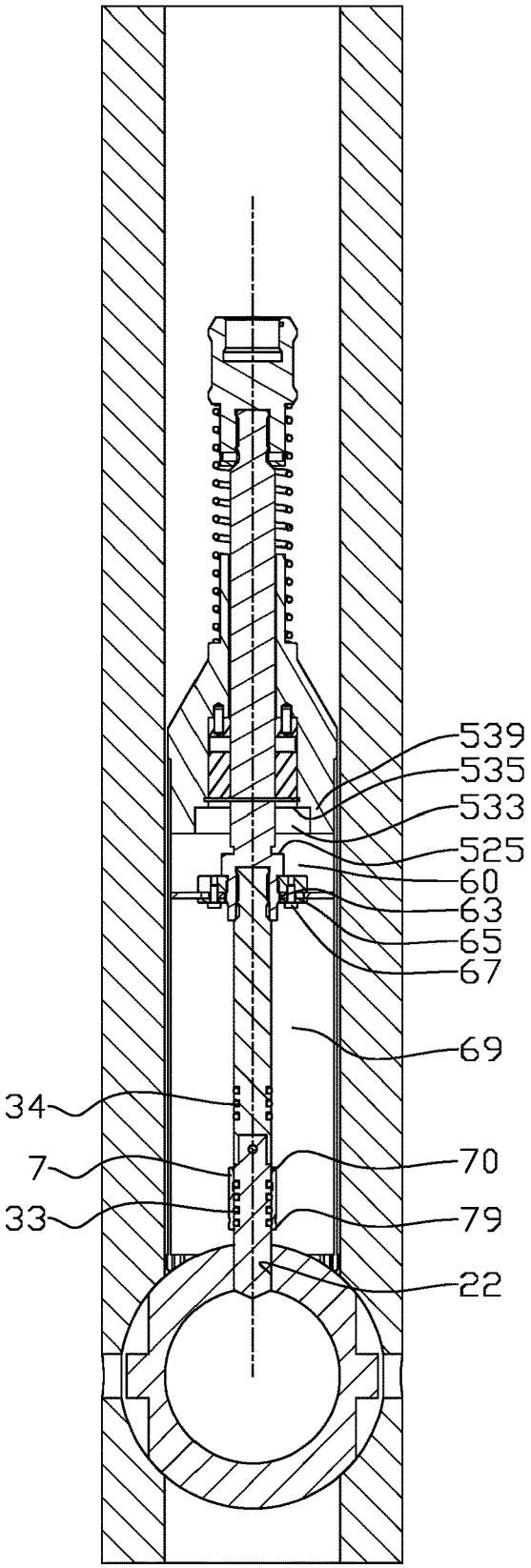
Figure 9:
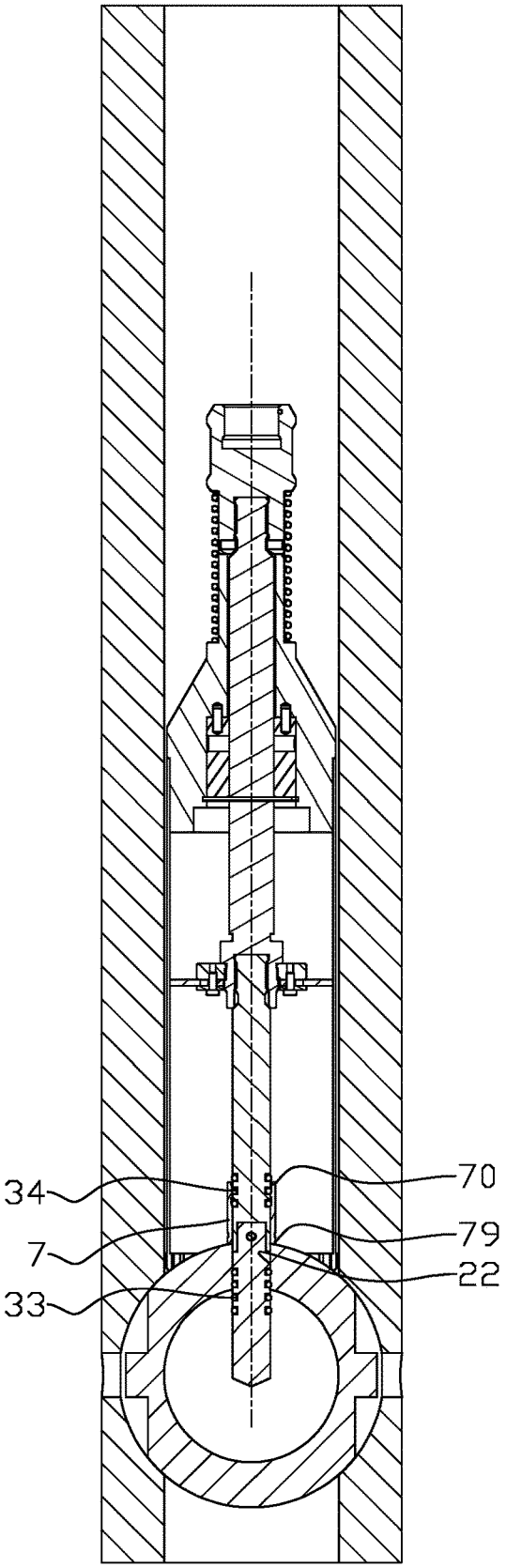
Figure 18:
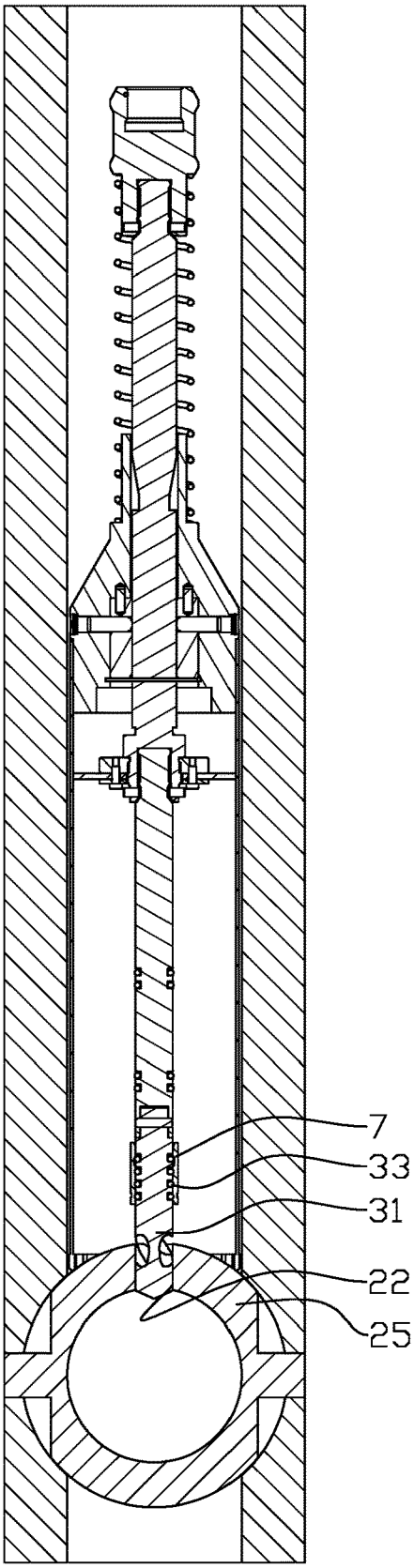
Figure 19:
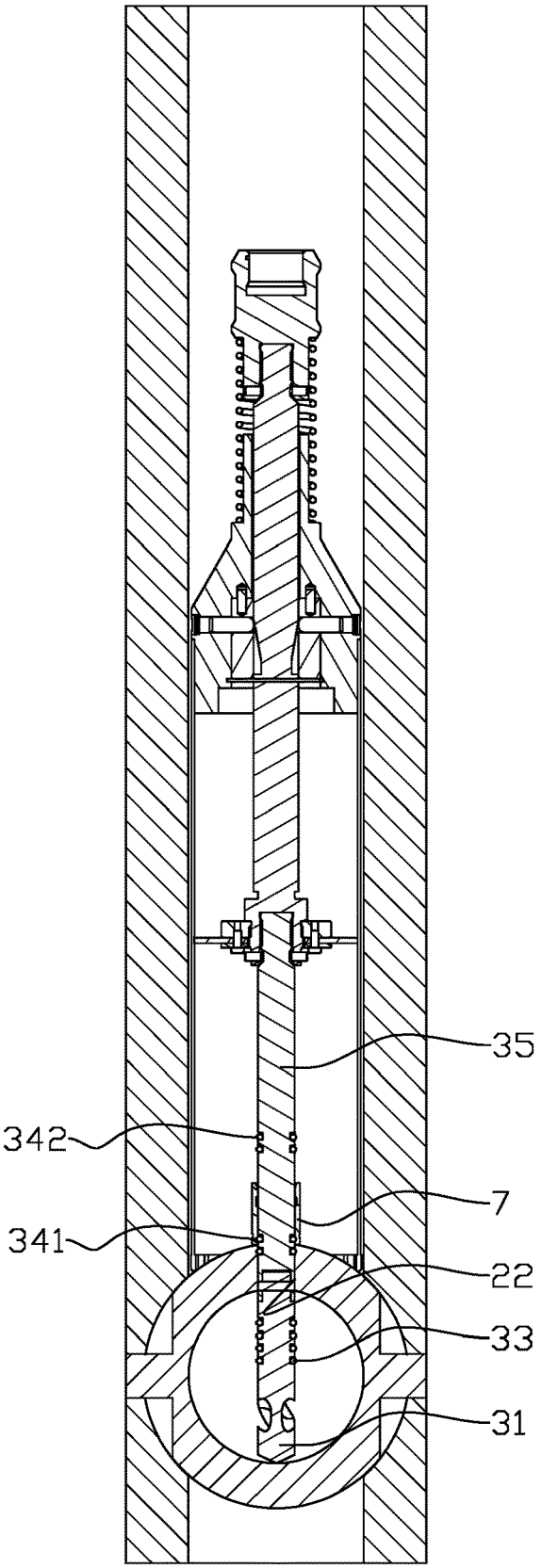
Figure 20:
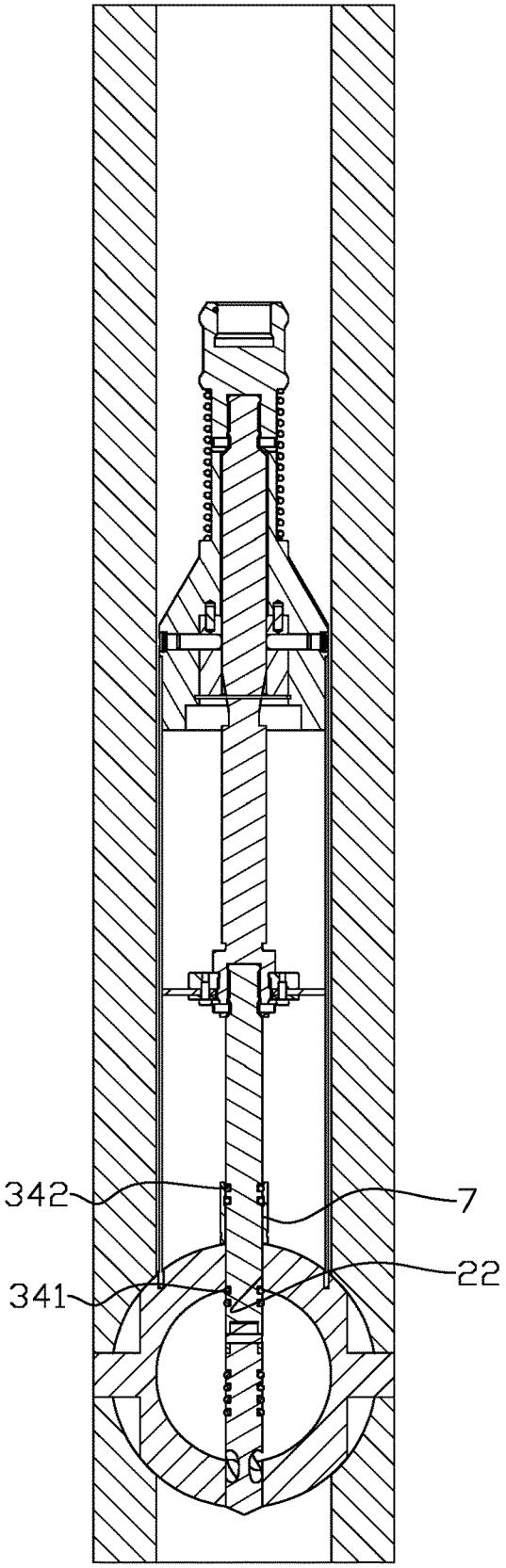

The drill bit 31 makes a through hole 22 in the ball valve 25 as shown in FIGS. 8 and 18. When the drill bit 31 breaks through top half of the ball valve 25, there is no axial resistance and the drill bit 31 is displaced to its maximum distal position relative to the cutting assembly as shown in FIG. 9. In an alternative embodiment shown in FIGS. 17 to 26, the extended holder 35 is longer. The drill bit 31 abuts an internal wall of the ball valve 25 as shown in FIG. 19.

Figure 10:
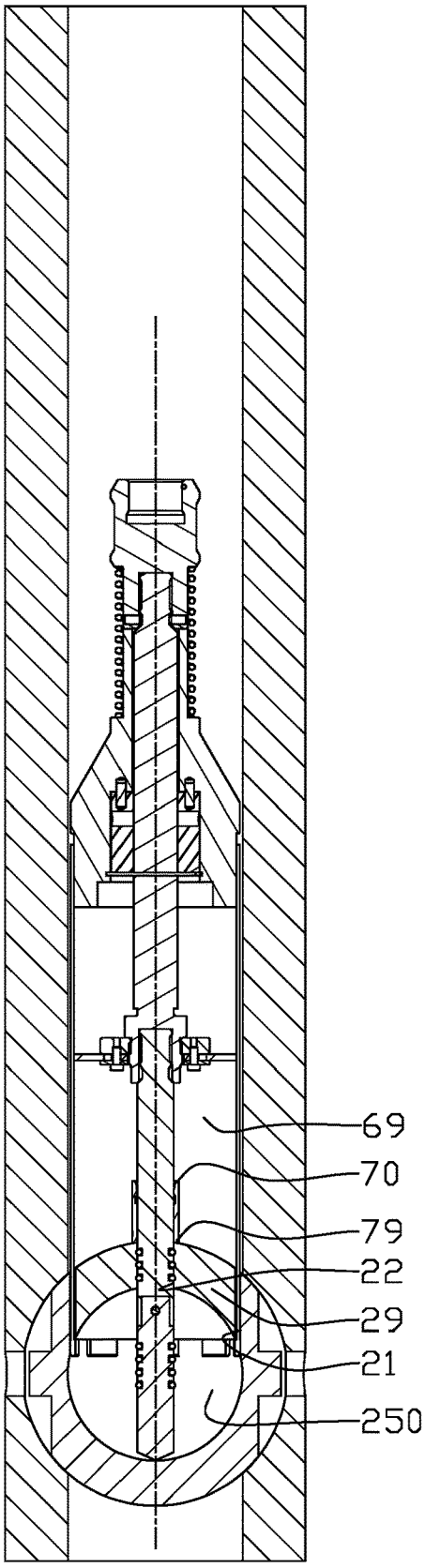

The spring 54 is compressed and the weight on bit is transferred to the cutting assembly 4. During the displacement of the drill bit 31, the distal end portion 79 of the sleeve 7 abuts the outer surface of the ball valve 25. The sleeve 7 has a larger diameter than the drill bit 31. Thereby the sleeve 7 is axially displaced along the extended holder 35 towards the proximal end 359. The catcher 33 which from the start is retracted within the sleeve 7, enters the through hole 22 in the retracted mode as the inner diameter of the sleeve 7 equals the diameter of the through hole 22 as shown in FIG. 9. FIGS. 10 and 19 show the catcher 33 after the catcher 33 has been fully displaced through the first part of the ball valve 25. The catcher 33 enters the expanded mode after passage of the through hole 22 as seen in FIGS. 10 and 19. The chamfered proximal end portion 70 of the sleeve 7 slides over the retainer 34 and forces the retainer 34 to enter a retracted mode as shown in FIG. 9.

Figure 11:
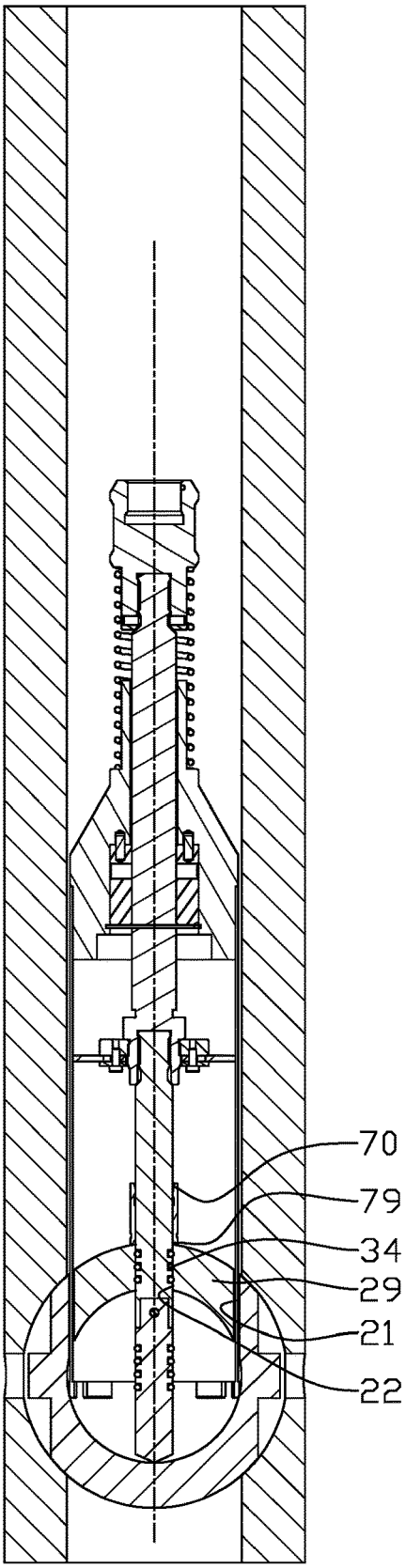
Figure 12:
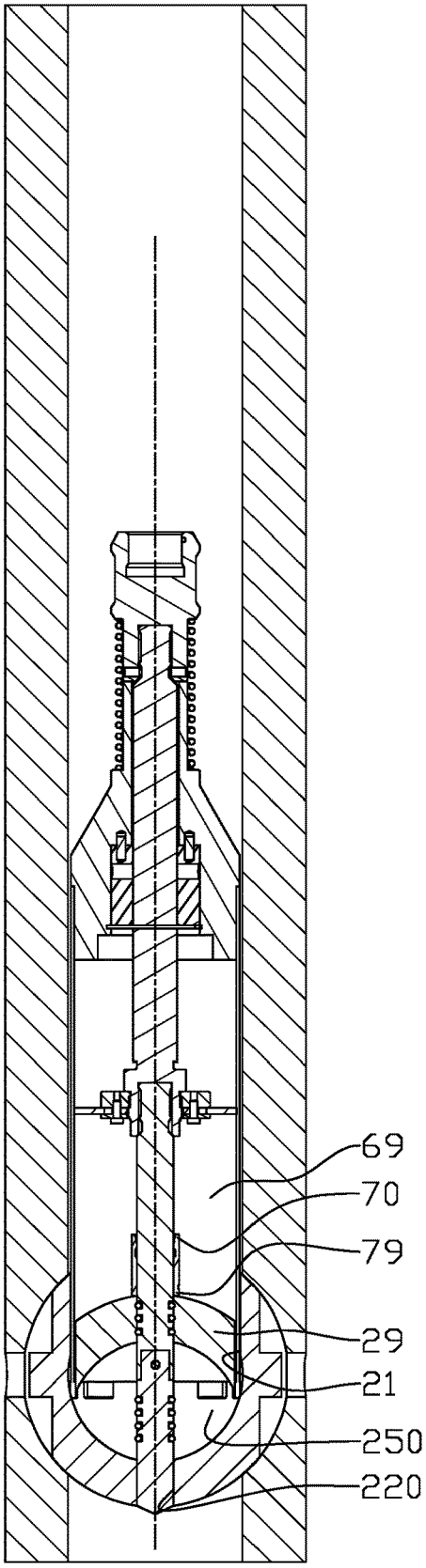

The cutting assembly 4 cuts out a first disc 29 and creates a passage 21 in the wall of the ball valve 25 as seen in FIGS. 10 to 12. FIGS. 10 to 12 show when the cutting assembly 4 has penetrated the ball valve 25 and the disc 29 is within the receiving compartment 69. Due to that the weight on bit is on the cutting assembly 4, the drill bit assembly 3 is axially displaced at the same speed as the cutting assembly 4 into the interior of the ball valve 25 as seen by comparing FIGS. 9 and 10. The extended holder 35 is thereby axially displaced relative to the ball valve 25. The sleeve 7 is further displaced along the extended holder 35 towards the proximal end 359. The retainer 34 which is retracted within the sleeve 7, enters the through hole 22 in the retracted mode as the inner diameter of the sleeve 7 equals the diameter of the through hole 22. The thickness of the wall of the ball valve 25 is known and the axial position of the retainer 34 on the extended holder 35 is adapted to this. When the cutting assembly 4 breaks through the wall of ball valve 25, the retainer 34 is positioned within the disc 29 as shown in FIG. 10. The retainer 34 remains within the disc 29 when the drill bit 31 advances through the second wall of the ball valve 25 as seen in FIGS. 10 to 12. The retainer 34 presses against the interior of the through hole 22 and secures that the disc 29 remains within the receiving compartment 69 and rotates together with the cutting assembly 4.

When the cutting assembly 4 breaks through the wall of the ball valve 25 and forms the passage 21, there is no axial resistance to the drilling assembly 1. The drill bit assembly 3 is via the drive shaft 52 directly connected to the adapter 51. The adapter 51 is connected to the wireline tractor (not shown). Therefore, the drill bit assembly 3 will not be axially displaced. The cutting assembly 4 will be displaced axially in the distal direction due to the compressed spring 54 which is released when there is no axial resistance to the cutting assembly 4. Thereby the cutting assembly 4 is displaced axially relative to the drill bit assembly 3 and the disc 29 as shown by comparing FIG. 10 with FIG. 11. The retainer 34 holds the disc 29 such that the disc 29 is displaced into the receiving compartment 69 as shown in FIG. 11. The length of the relative axially displacement of the cutting assembly 4 is determined by the dimension of an internal cavity 250 of the ball valve 25.

Figure 13:
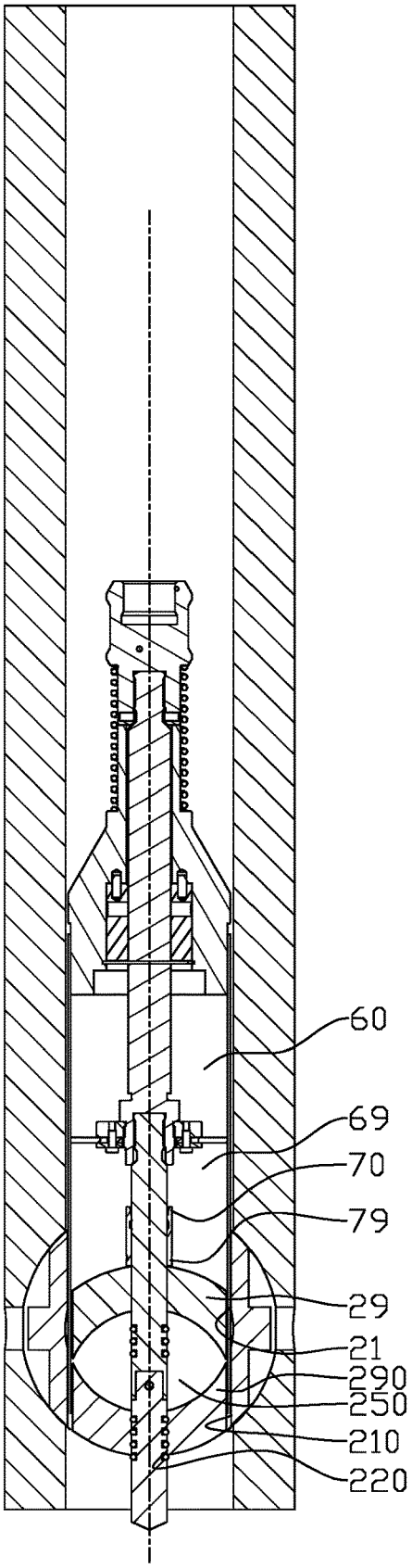
Figure 14:
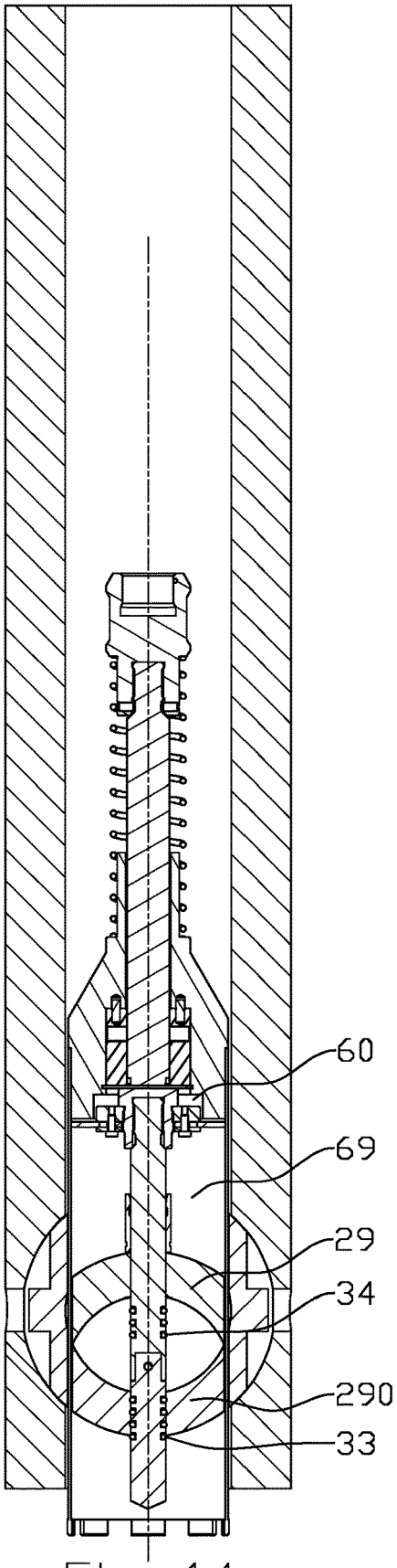
Figure 15:
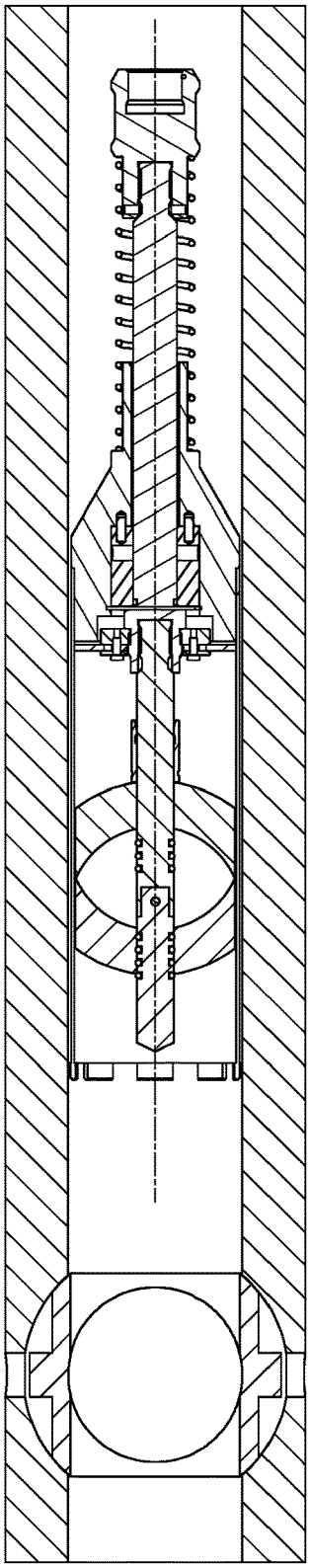

Full weight on bit is again transferred to the drill bit 31 and the drill bit 31 makes a second through hole 220 in the second wall of the ball valve 25 as shown in FIG. 12. Weight on bit is transferred to the cutting assembly 4 which makes a second passage 210 in the ball valve 25 as shown in FIGS. 13 to 15. A second disc 290 is formed. The disc 29 abuts the interior wall of the internal cavity 250 and is displaced in the proximal direction of the drilling assembly 3 when the drill bit 31 has penetrated the second wall of the ball valve 25 and is further displaced through the ball valve 25. The disc 29 slides off the retainer 34. The retainer 34 enters an expanded mode on the distal side of the disc 29 and secures the disc 29 from dropping off the drill assembly 3 as seen in FIG. 13.

When the cutting assembly 4 breaks through the whole ball valve 25 and have formed the passages 21, 210, there is no axial resistance to the drilling assembly 1. The drill bit assembly 3 is via the drive shaft 52 directly connected to the adapter 51. The adapter 51 is connected to the wireline tractor (not shown). Therefore, the drill bit assembly 3 will not be axially displaced. The cutting assembly 4 will be displaced axially in the distal direction due to the compressed spring 54 which is released when there is no axial resistance to the cutting assembly 4. Thereby the cutting assembly 4 is displaced axially relative to the drill bit assembly 3 and the discs 29, 290 as shown in FIG. 14.

The membrane 6 has a diameter that is close to the inner diameter of the tubular body 41, but with a small clearance to an inner wall 411 (see FIG. 7) such that the membrane 6 does not act as a seal. The membrane holder 61 is shown fixed to the drive shaft 52. By comparison of FIGS. 7 and 9, the distal displacement of the membrane 6 increases the volume of the inner compartment 60 and decreases the volume of the receiving compartment 69. When the cutting assembly 4 breaks through the complete ball valve 25, the membrane 6 is displaced relative to the cutting assembly 4. The inner compartment 60 decreases in volume and liquid in the inner compartment 60 is evacuated through the insert 56. The receiving compartment 69 expands, which creates a sub-pressure in the receiving compartment 69. The discs 29, 290 have a diameter that corresponds to the internal diameter of the tubular body 41. The pressure on the proximal side of the discs 29, 290 is less than on the distal side, and this pressure difference ensures that the discs 29, 290 stay within the tubular body 41 when the cutting assembly 4 is displaced distally relative to the drill bit 31.

The dimensions of the ball valve 25 are known and the axial distance between the catcher 33 and the retainer 34 is adjusted to the dimensions of the ball valve 25. Thereby the retainer 34 is positioned within the disc 29 when the cutting assembly 4 breaks through the first wall of the ball valve 25 as seen in FIGS. 10 to 12. The retainer 34 is adapted to be rotated within the through hole 22 without losing the retaining capacity such that when the disc 29 is fully formed, the retainer 34 holds the disc 29 and the disc 29 rotates together with the cutting assembly 4.

Break through of the complete ball valve 25 is noticed by a controlling system (not shown) as a drop of torque and a drop of weight on bit on the drilling assembly 1. The wireline tractor (not shown) and the drilling assembly 1 is then withdrawn from the ball valve 25 as seen in FIG. 15. The disc 29 is shown secured within the tubular body 41 by the retainer 34. The catcher 33 is positioned within the second disc 290. The second disc 290 is positioned within the tubular body 41. This safeguards the disc 29 and the second disc 290 from falling out of the tubular body 41 during the withdrawal of the drilling assembly 1 in the production tube. In addition, if the discs 29, 290 are displaced distally relative to the membrane 6, the pressure in the receiving compartment 69 on the proximal side of the disc 29 will drop, and the higher pressure on the distal side of the discs 29, 290 will counteract the distal displacement. Together, these measures will secure that the discs 29, 290 do not fall out of the drilling assembly 1 during withdrawal.

Figure 16:
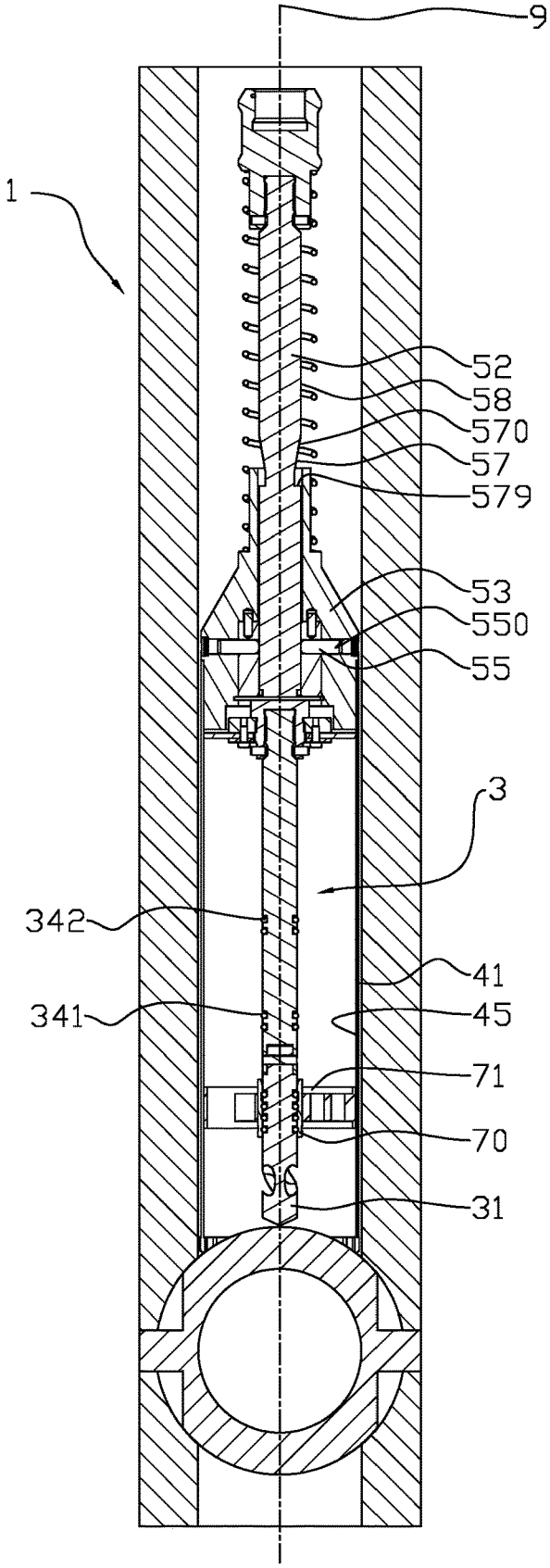
FIG. 16 shows the drilling assembly in an embodiment where a central bit assembly is provided with a lateral support.

An alternative embodiment of the drilling assembly 1 is shown in FIG. 16. In this embodiment the displaceable sleeve 7 is provided with a spacer 71. The spacer 71 abuts an internal face 45 of the tubular body 41. The spacer 71 may be provided with a slide bearing (not shown) that abuts the internal face 45. The spacer 71 and the sleeve 7 support the drill bit assembly 3 such that the drill bit 31 is rotating around the centre axis 9.

An alternative embodiment of the drilling assembly 1 is shown in FIGS. 16 to 27. In this embodiment the drilling assembly 1 is provided with the spring-loaded bolt 55 within the radial bore 550 in the slidable house 53. The drive shaft 52 is on the surface 58 provided with at least one recess 57 formed with a sloping proximal end portion 570 and an opposite shoulder 579. The recess 57 is adapted to receive the spring-loaded bolt 55.

Figure 21:
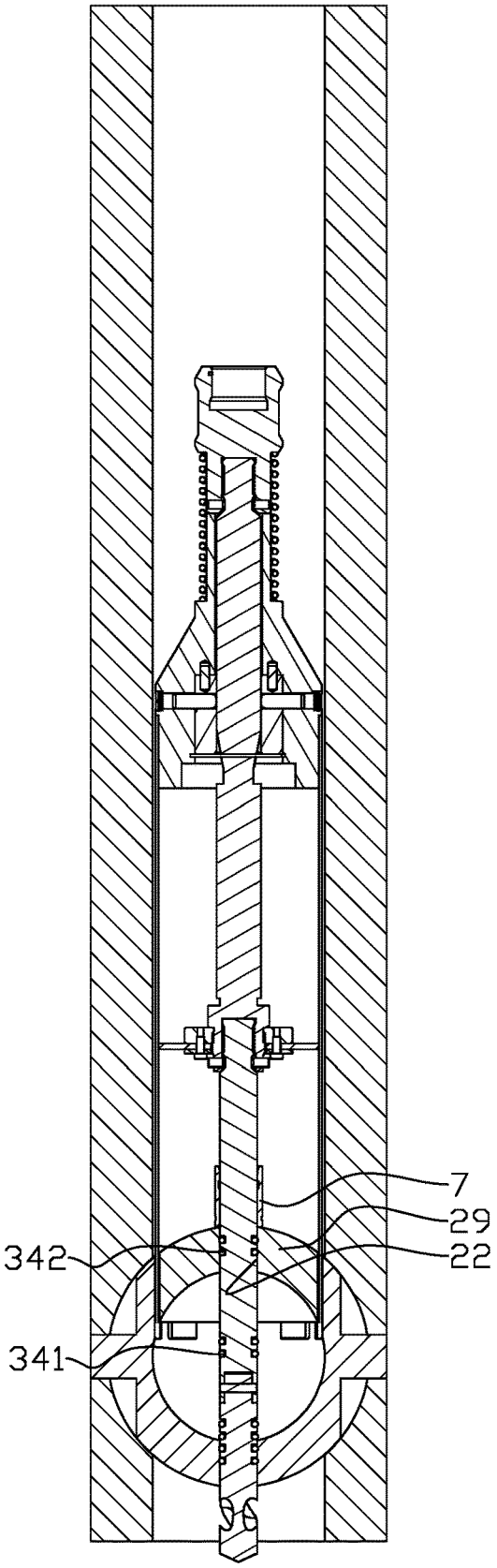
Figure 22:
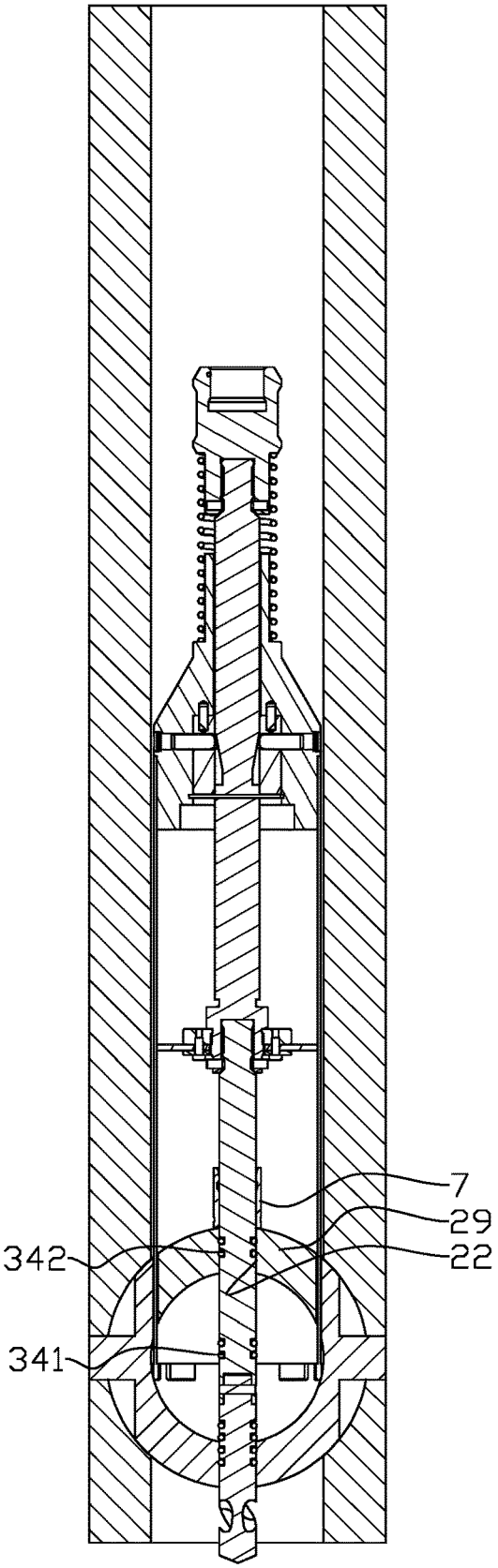
Figure 23:
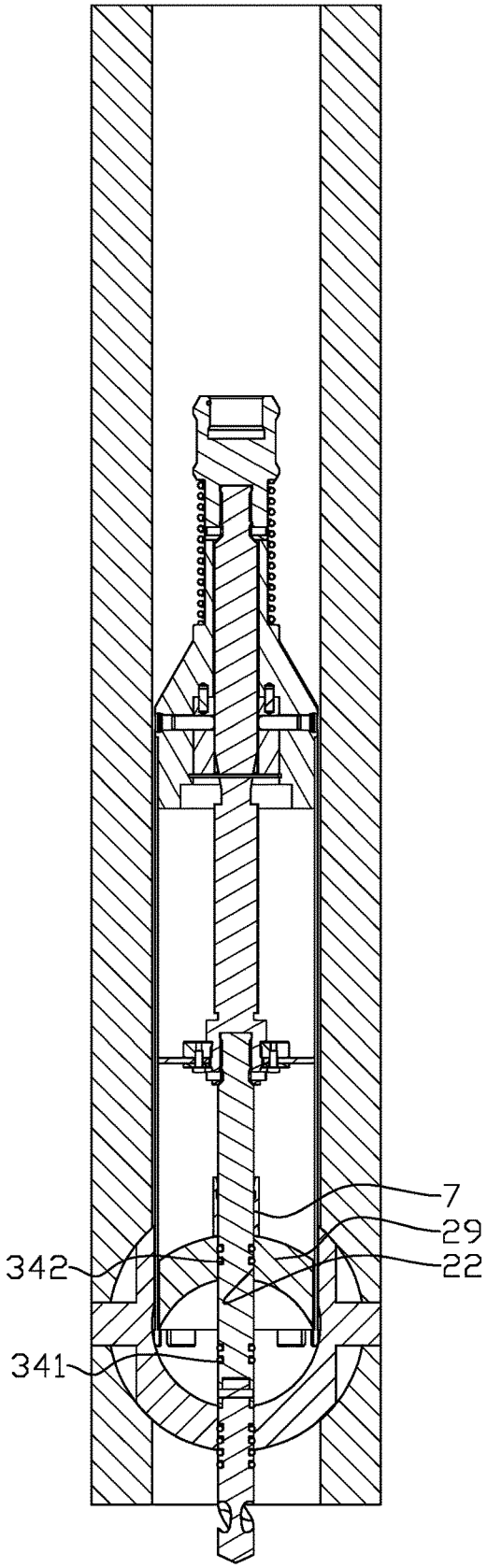
Figure 24:
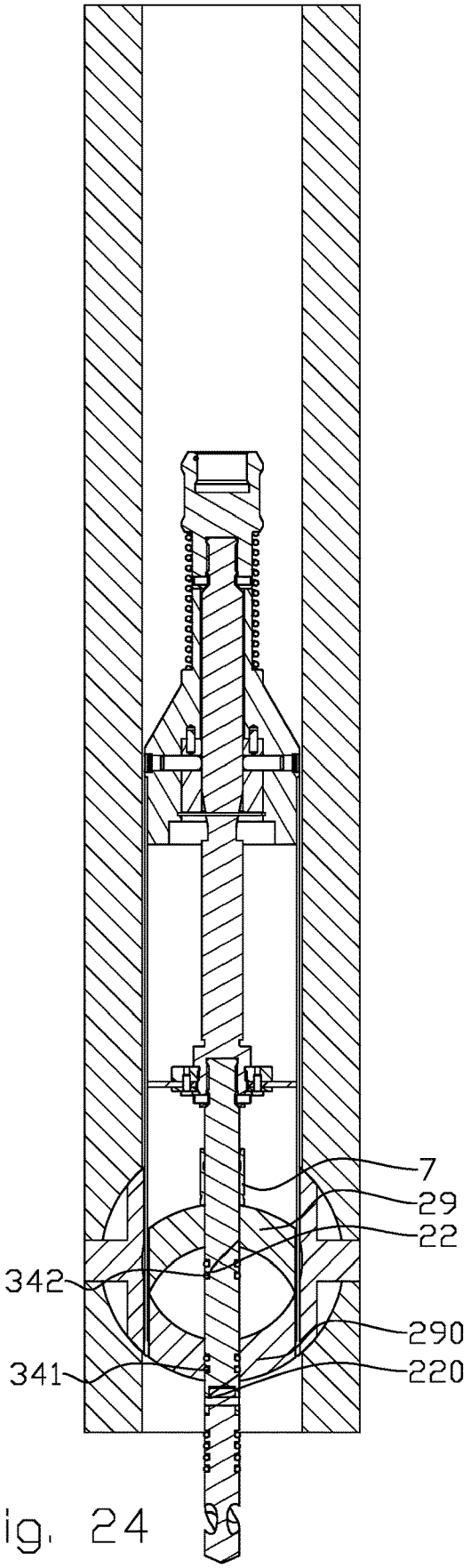
Figure 25:
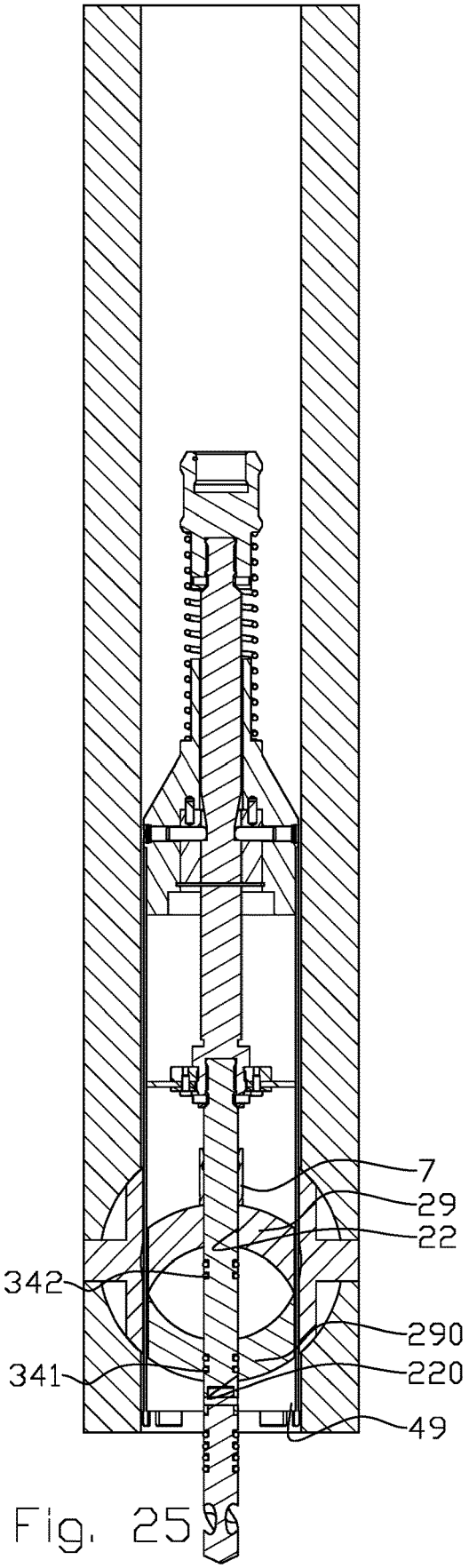
Figure 26:
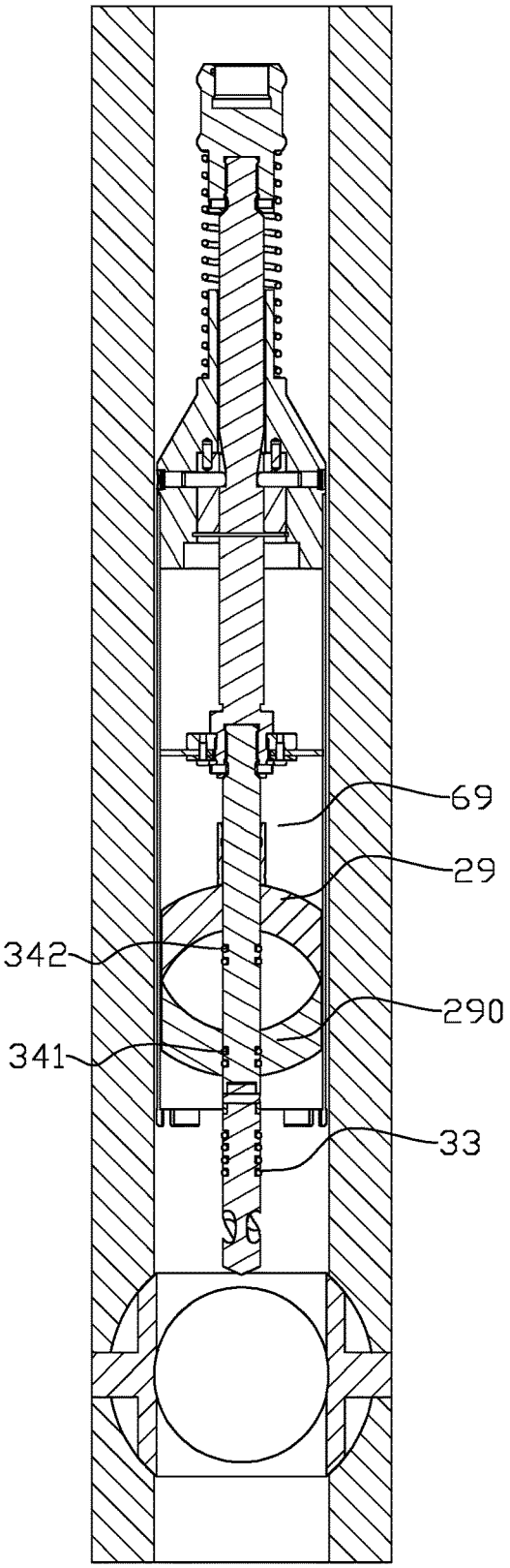

An alternative embodiment of the drilling assembly 1 is shown in FIGS. 16 to 27. In this embodiment the drilling assembly 1 comprises two retainers 341, 342. The first retainer 341 is positioned on the extended holder 35 such that the first retainer 341 has entered the through hole 22 when the drill bit 31 abuts the internal wall of the ball valve 25 as shown in FIG. 19. The displaceable sleeve 7 slides over the first retainer 341 and then over the second retainer 342 as shown by comparing FIGS. 18 to 20 when the displaceable sleeve 7 abuts the outer surface of the ball valve 25. The second retainer 342 is positioned on the extended holder 35 such that the second retainer 342 is positioned within the disc 29 when the cutting assembly 4 breaks through the first wall of the ball valve as seen in FIG. 21. The retainer 342 presses against the interior of the through hole 22 and secures that the disc 29 remains within the receiving compartment 69 and rotates together with the cutting assembly 4 as seen in FIGS. 21 to 23. The disc 29 is pushed off the second retainer 342 when the disc 29 abuts the opposite internal wall of the ball valve 25 while the drill bit assembly 3 and the cutting assembly 4 is cutting further into the ball valve 25 as seen in FIG. 24. The first retainer 341 has entered the second through hole 220 in the disc 290 as shown in FIGS. 24 to 26.

Break through of the complete ball valve 25 is noticed by a controlling system (not shown) as a drop of torque and a drop of weight on bit on the drilling assembly 1. The wireline tractor (not shown) and the drilling assembly 1 is then withdrawn from the ball valve 25 as seen in FIG. 26. The disc 29 is shown secured within the tubular body 41 by the first retainer 341. The second disc 290 is shown secured within the tubular body 41 by the second retainer 342 The catcher 33 is positioned in a proximal position relative to the second disc 290. The second disc 290 is positioned within the tubular body 41. This safeguards the disc 29 and the second disc 290 from falling out of the tubular body 41 during the withdrawal of the drilling assembly 1 in the production tube. In addition, if the discs 29, 290 are displaced distally relative to the membrane 6, the pressure in the receiving compartment 69 on the proximal side of the disc 29 will drop, and the higher pressure on the distal side of the discs 29, 290 will counteract the distal displacement. Together, these measures will secure that the discs 29, 290 do not fall out of the drilling assembly 1 during withdrawal.

Figure 27:
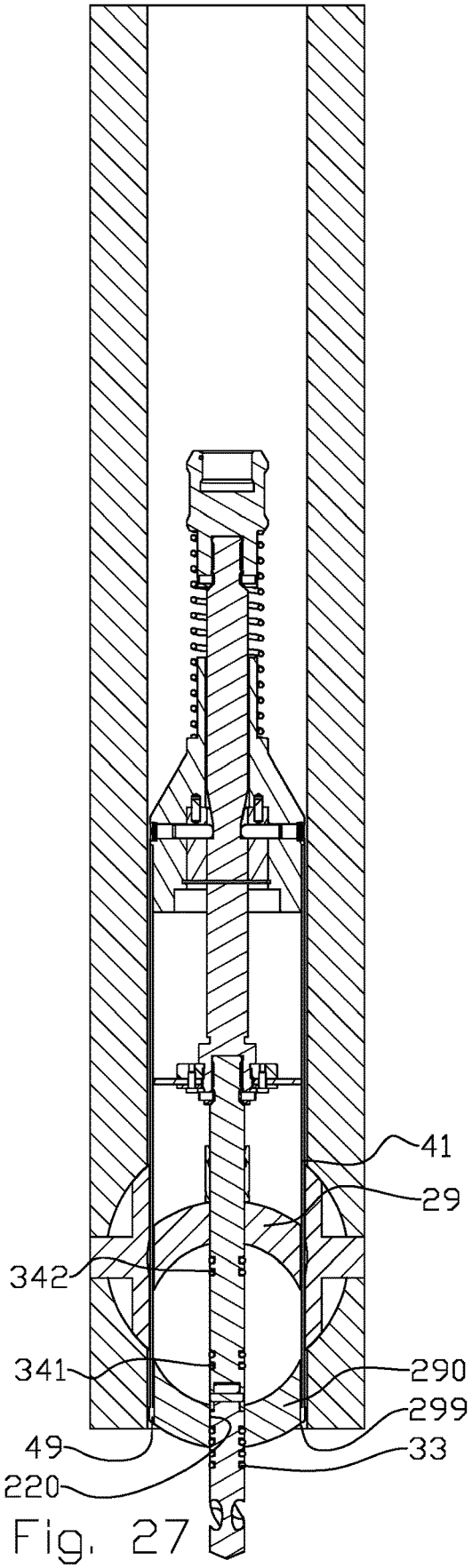
FIG. 27 show the drilling assembly shown in FIGS. 17 to 26, where the outermost disc is secured by a catcher.

In case the burr 299 of the second disc 290 is too stiff, the second disc 290 will remain in the mouth portion 49 of the tubular body 41 as shown in FIG. 27. The catcher 33 will be partly inside the second through hole 220 and partly on the distal side of the second disc 290. This will secure that the disc 290 does not fall out of the drilling assembly 1 during withdrawal.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A drilling assembly for making a passage in an object within a petroleum well, said drilling assembly is adapted to be displaced by a wireline tractor and supplied with a rotational force from a rotational motor, and said drilling assembly comprising:

a drill bit assembly;

a cutting assembly;

a rotatable drive assembly;

said drilling assembly forming a longitudinal center axis;

said drill bit assembly and the cutting assembly being fastened to the rotatable drive assembly;

said drill bit assembly comprises a drill bit at a free end of the drill bit assembly;

said cutting assembly is formed by a tubular body having a mouth portion provided with a hole saw assembly;

said cutting assembly being resiliently displaceable relative to the drill bit assembly along the center axis;

the drilling assembly further comprises a displaceable membrane within the tubular body, said displaceable membrane divides an interior of the tubular body into a receiving compartment of variable volume and an inner compartment of variable volume, and said displaceable membrane is fastened to one of the rotatable drive assembly and the drill bit assembly.

2. The drilling assembly according to claim 1, wherein the drill bit assembly comprises a catcher at a distal portion of the drill bit.

3. The drilling assembly according to claim 1, wherein the drill bit assembly comprises a retainer at a middle portion of the drill bit.

4. The drilling assembly according to claim 1, wherein the drill bit assembly comprises a displaceable sleeve adapted to slide along a surface of the drill bit assembly, said displaceable sleeve having a proximal end portion and a distal end portion.

5. The drilling assembly according to claim 4, wherein the displaceable sleeve is formed with an internal chamfer at the proximal end portion.

6. The drilling assembly according to claim 4, wherein the displaceable sleeve is provided with a spacer and the spacer is adapted to abut an internal face of the tubular body.

7. The drilling assembly according to claim 1, wherein the rotatable drive assembly has a proximal end and a distal end, the drilling assembly comprises:

an adapter;

a drive shaft having a distal end and a proximal end, the drive shaft being connected to the adapter at the proximal end of the drive shaft and to the drill bit assembly at the distal end of the drive shaft, said drive shaft being formed with a polygonal cross-section at the proximal end;

a slidable house comprising a central channel and provided with an external circular distal end connected to the cutting assembly;

a spring encircling the drive shaft between the adapter and the slidable house, and the drive shaft is formed with an enlarged diameter at the distal portion, said enlarged diameter forms a shoulder.

8. The drilling assembly according to claim 7, wherein the slidable house is provided with an insert with a central guide formed with a polygonal cross section adapted for receiving the drive shaft.

9. The drilling assembly according to claim 7, wherein the slidable house is provided with at least one radially oriented spring-loaded bolt, and the drive shaft is provided with at least one recess, said at least one recess is formed with a sloping proximal end portion and a distal shoulder, and said at least one recess is adapted to receive the spring-loaded bolt.

10. A method for drilling a passage in an object within a petroleum well, the method comprises:

providing a drilling assembly forming a longitudinal center axis; the drilling assembly comprises: a drill bit assembly comprising a drill bit at a free end of the drill bit; a cutting assembly formed by a tubular body having a mouth portion provided with a hole saw assembly, and the cutting assembly being resiliently displaceable to the drill bit assembly along the center axis; a rotatable drive assembly; the drill bit assembly and cutting assembly being fastened to the rotatable drive assembly; a displaceable membrane within the tubular body, the displaceable membrane dividing an interior of the tubular body into a receiving compartment of variable volume and an inner compartment of variable volume, and the displaceable membrane being fastened to one of the rotatable drive assembly and the drill bit assembly;

connecting the drilling assembly to a wireline tractor;

displacing the drilling assembly within the petroleum well by the wireline tractor and positioning the drilling assembly in contact with the object;

engaging the rotatable drive assembly and adding weight on the drill bit assembly such that the spring becomes partly compressed;

making a through hole in the object by the drill bit;

adding further weight on the cutting assembly such that the spring becomes further compressed and cutting out at least one disc from the object; and displacing the cutting assembly forwardly and relative to the membrane by the biasing force of the compressed spring, thereby evacuating fluid in the inner compartment proximally along the drive shaft and keeping a distance between the membrane and the disc constant by a sub-pressure in the receiving compartment, and thereby the disc follows the membrane in the proximal direction into the receiving compartment.

11. The method according to claim 10, wherein the method comprises providing the drilling assembly with a displaceable sleeve prior to guiding the drilling assembly into the petroleum well, and positioning the sleeve on the drill bit assembly to cover the catcher and keeping a catcher in a flush state with a surface of the drill bit assembly.

12. The method according to claim 11, wherein the method comprises guiding the catcher into the through hole in the flush state by abutting the sleeve's distal end portion with the object and displacing the sleeve proximally along the drill bit assembly when the drill bit assembly drills through the object.

13. The method according to claim 12, wherein the method comprises guiding the sleeve over a retainer to squeeze the retainer into a flush state with the surface of the drill bit assembly.

14. The method according to claim 13, wherein the method comprises guiding the retainer into the through hole in the flush state by abutting the sleeve's distal end portion with the object and displacing the sleeve proximally along the drill bit assembly when the drill bit assembly is displaced distally relative to the object.

15. The method according to claim 10, wherein the method comprises keeping a retainer positioned within the through hole when the disc is retrieved from the well.

16. The method according to claim 10, wherein the method comprises cutting an additional disc from a ball valve and keeping a the catcher positioned within the second through hole of the distal disc when the discs are retrieved from the well.

* * * * *